US010704277B1

(12) United States Patent
Graf

(10) Patent No.: US 10,704,277 B1
(45) Date of Patent: Jul. 7, 2020

(54) FLOW CHANNEL FORM DESIGN FOR MANHOLE ASSEMBLIES

(71) Applicant: S & M Precast, Inc., Henryville, IN (US)

(72) Inventor: Raymond L. Graf, Memphis, IN (US)

(73) Assignee: S & M Precast, Inc., Henryville, IN (US)

( * ) Notice: Subject to any disclaimer, the term of this patent is extended or adjusted under 35 U.S.C. 154(b) by 545 days.

(21) Appl. No.: 15/415,479

(22) Filed: Jan. 25, 2017

(51) Int. Cl.

| | |
|---|---|
| ***E03F 5/02*** | (2006.01) |
| ***E04G 15/00*** | (2006.01) |
| ***B28B 7/00*** | (2006.01) |
| ***B28B 1/14*** | (2006.01) |
| ***B28B 11/24*** | (2006.01) |
| ***B28B 7/28*** | (2006.01) |

(52) U.S. Cl.
CPC ..... *E04G 15/00* (2013.01); *B28B 1/14* (2013.01); *B28B 7/0011* (2013.01); *B28B 7/28* (2013.01); *B28B 11/245* (2013.01); *E03F 5/02* (2013.01)

(58) Field of Classification Search
CPC .. E03F 5/02; E03F 5/027; E04G 15/00; B28B 7/168; B28B 11/245; F16L 5/02
See application file for complete search history.

(56) References Cited

U.S. PATENT DOCUMENTS

| | | | | |
|---|---|---|---|---|
| 3,363,876 A | | 1/1968 | Moore | |
| 3,714,961 A | * | 2/1973 | Davidson | E02D 29/12 137/363 |
| 3,759,285 A | * | 9/1973 | Yoakum | B28B 23/0043 137/363 |
| 4,119,291 A | | 10/1978 | Polito | |
| 4,422,994 A | | 12/1983 | Ditcher | |
| 4,484,724 A | | 11/1984 | Srackangast | |
| 4,746,127 A | * | 5/1988 | Westhoff | E03F 5/02 277/314 |
| 4,801,417 A | * | 1/1989 | Ditcher | B28B 7/04 264/250 |
| 4,941,643 A | | 7/1990 | Ditcher | |
| 5,261,761 A | * | 11/1993 | Knappert | E03F 5/021 285/148.18 |
| 5,303,518 A | * | 4/1994 | Strickland | E02D 29/124 52/21 |
| 5,413,307 A | | 5/1995 | Tidwell | |
| 5,806,829 A | | 9/1998 | Banks | |
| 7,059,806 B2 | | 6/2006 | Transgsrud | |

OTHER PUBLICATIONS

A-Lok Products, Inc., "Tru-contour, Secondary Invert Forming System," General Information, U.S. Pat. No. 4,484,724.

* cited by examiner

*Primary Examiner* — Nahida Sultana
*Assistant Examiner* — Debjani Roy
(74) *Attorney, Agent, or Firm* — Middleton Reutlinger

(57) ABSTRACT

The present disclosure is generally directed to processes and apparatuses for use in forming one or more flow channels within a prefabricated manhole assembly. More specifically, an exemplary apparatus embodying various aspects of the disclosure may contain a rigid channel form with a closed top portion, a curved bottom portion, a first end, and a second end. The apparatus may also contain a bung(s) removably positioned into an exterior hole through a side-wall of the prefabricated manhole that may receive one end of the channel form, the bung(s) interior end may further have an open-ended U-shaped slot. A sliding wedge may be used to engaged/disengage the flow channel form.

12 Claims, 6 Drawing Sheets

FLOW CHANNEL FORM DESIGN FOR MANHOLE ASSEMBLIES

FIELD

The present disclosure is directed to processes and apparatuses for use in forming one or more flow channels within a prefabricated manhole assembly.

BACKGROUND

Generally, manhole assemblies consist of a base, an intermediate section, and a top section capable of receiving a manhole cover. Manholes are typically cylindrical in nature and contain inlet and outlet openings in the sidewalls configured to receive at least one pipe. Typically, manhole assemblies are provided where there is a change in the direction of the pipes, a junction of multiple pipe-lines, a change in slope, or the like. Therefore, it may be desirable in some embodiments to allow fluids (e.g. sewage) to continue to flow through the manhole, substantially uninterrupted and substantially same flow rate, regardless of the change in direction, slope, etc.

Various methods of manhole construction are known in the art. Furthermore, flow channels are typically formed through a separate process following the fabrication of the manhole assemblies. Accordingly, various methods of secondary form flow channel assemblies are also known in the art. However, there are many limitations to these channel forms. For example, these forms have an open top in which cement may enter the interior of the channel form during cement filling. Cement entering the interior of the channel form makes removal and clean-up of and reuse of the form difficult. Furthermore, channel forms known in the art become buoyant in uncured cement causing them to float and move from their intended positioning, which may affect the quality of the products produced. There exists a need in the art for a reusable secondary form for a flow channel that overcomes, but is not limited to, these limitations.

SUMMARY

The disclosure herein is directed to a reusable apparatus for forming a flow channel for use in a prefabricated manhole. In one aspect a reusable apparatus for forming a flow channel for use in a prefabricated manhole is described. Such an apparatus may comprise: a rigid channel form, the channel form containing a closed top portion, a curved bottom portion, a first end, and a second end; at least one bung removably positioned into an exterior hole through a sidewall of the prefabricated manhole, where the at least one bung is configured to receive one of the first or the second end of the channel form, where the at least one bung comprises an interior end removably connected to the channel form and an exterior end, the interior end further comprising an open-ended U-shaped slot receiving said one of said first end or said second end of said channel form; and, at least one movable wedge slidably received by the at least one bung, the wedge slides between an engaged position where the flow channel is fixed between the wedge and the U-shaped slot and a disengaged position where the flow channel is either inserted or removed from the U-shaped slot.

In some embodiments, the apparatus also includes at least one rotational lock removably engaged with a first end of the wedge extending outward from the exterior end of the bung. In some instances, the at least one rotational lock includes a main body with a slot between a plurality of depending legs, where the slot releasably receives said first end of the wedge. In still other embodiments, the at least one rotational lock further comprises a vertical slot that is a point of attachment with the wedge and a plurality of kickstand legs extending downward such that each of the plurality of kickstand legs rest on a surface below the prefabricated manhole. In some instances, the plurality of kickstand legs resist rotational forces created by recently poured concrete.

In other embodiments, each of the first and second ends of the rigid channel form are tapered, such that a width of the closed top portion of each the first and the second end is larger than the curved bottom portion of each the first and the second end. In still other embodiments, the hollow rigid channel form is substantially closed at each of the first and the second ends. In some embodiments, when in the disengaged position the wedge is slid outwardly away from the exterior end of the bung, allowing the channel form to be removed from the prefabricated manhole. In other embodiments, a void is left by said U-shaped slot, which provides a space for grout to be inserted about a pipe during an installation process.

In some embodiments, the at least one wedge has a flange at each opposing end to maintain interconnectivity with the bung. In some embodiments, this flange at each opposing end holds the at least one rotational lock from sliding along a longitudinal axis. In still other embodiments, the apparatus further comprises another rigid channel form, wherein the rigid channel form is a different angle than the another rigid channel form.

In another aspect, a reusable apparatus for forming a flow channel for use in a prefabricated manhole is described. Such an apparatus may comprise: a hollow rigid channel form, the channel form containing a closed top portion, a curved bottom portion, a first end, and a second end, where each the first and the second ends of the hollow rigid channel form are substantially closed and tapered, such that the width of the closed top portion of each the first and the second end is larger than the curved bottom portion of each the first and the second end; at least one bung removably positioned into an exterior hole through a sidewall of the prefabricated manhole configured to receive one of the first end or second ends of the channel form, where the bung contains an interior end removably connected to the channel form and an exterior end the interior end further contains an open-ended U-shaped slot receiving either the first end or the second end of the channel form; and, at least one movable wedge positioned between the exterior end and the interior end of the bung, the wedge further containing a flange at each opposing end of the wedge, the flanges at each opposing end maintain interconnectivity with the bung, where the wedge slides into contact with the channel form to fix a position of the channel form relative to the bung and the wedge slides out of contact with the channel form to be able to insert or remove the channel form.

In some embodiments, the apparatus may further contain at least one perpendicularly oriented rotational lock removably engaged with a first end of the wedge extending outward from the exterior end of the bung, where the rotational lock further contains a vertical slot that is a point of attachment with the wedge and a plurality of kickstand legs extending downward such that each of the plurality of kickstand legs rest on a surface below the prefabricated manhole to resist rotational forces created by recently poured concrete. In other embodiments, the bung includes a through opening extending between the exterior end and the interior end, where the through opening receives the wedge.

In some instances, the wedge narrows towards the interior end of the bung. In still other embodiments, the channel form is out of contact with the wedge when the wedge is slid outward from the exterior end of the bung, allowing the channel form to be removed from the prefabricated manhole.

In still another aspect, a method of manufacturing a flow channel in a prefabricated manhole is disclosed. Such a method, may comprise the steps of: obtaining a prefabricated manhole having a sidewall with one or more inlets or one or more outlets; positioning at least one bung into at least one of the inlets or the outlets of the sidewall of the prefabricated manhole the bung having an interior end and an exterior end, where the bung includes a movable wedge therein; placing a closed hollow rigid channel form into the prefabricated manhole, the channel form comprising a top portion, a bottom portion, a first end, and a second end; inserting at least one the first end or the second end of the channel form into the interior end of the bung, where the interior end of the bung contains an open-ended U-shaped slot for receiving either the first end or the second end of the channel form; slidingly engaging the wedge into contact with the channel; pouring concrete into the prefabricated manhole; at least partially curing the concrete; slidingly disengaging the movable wedge out of contact with the channel form; and, removing the hollow rigid channel form from the prefabricated manhole creating a portion of the flow channel.

In some embodiments, the method further contains the step of releasably attaching at least one rotational lock with a first end of the wedge extending outward from the exterior end of the bung, the rotational lock containing a slot receiving the wedge and one or more kickstand legs extending downward such that at least one of the kickstand legs rests on a surface below the prefabricated manhole. In other embodiments, the wedge further contains a flange at each opposing end, the flange at each opposing end maintaining interconnectivity with the bung and preventing the rotational lock from sliding in a longitudinal axis. In still other embodiments, the method further contains the step of inserting a pipe into a portion of the flow channel created. In still yet other embodiments, the method further contains the step of applying grout about the pipe inserted in a void created by the U-shape slot of the bung.

DETAILED DESCRIPTION OF THE PREFERRED EMBODIMENT

Figure 1:
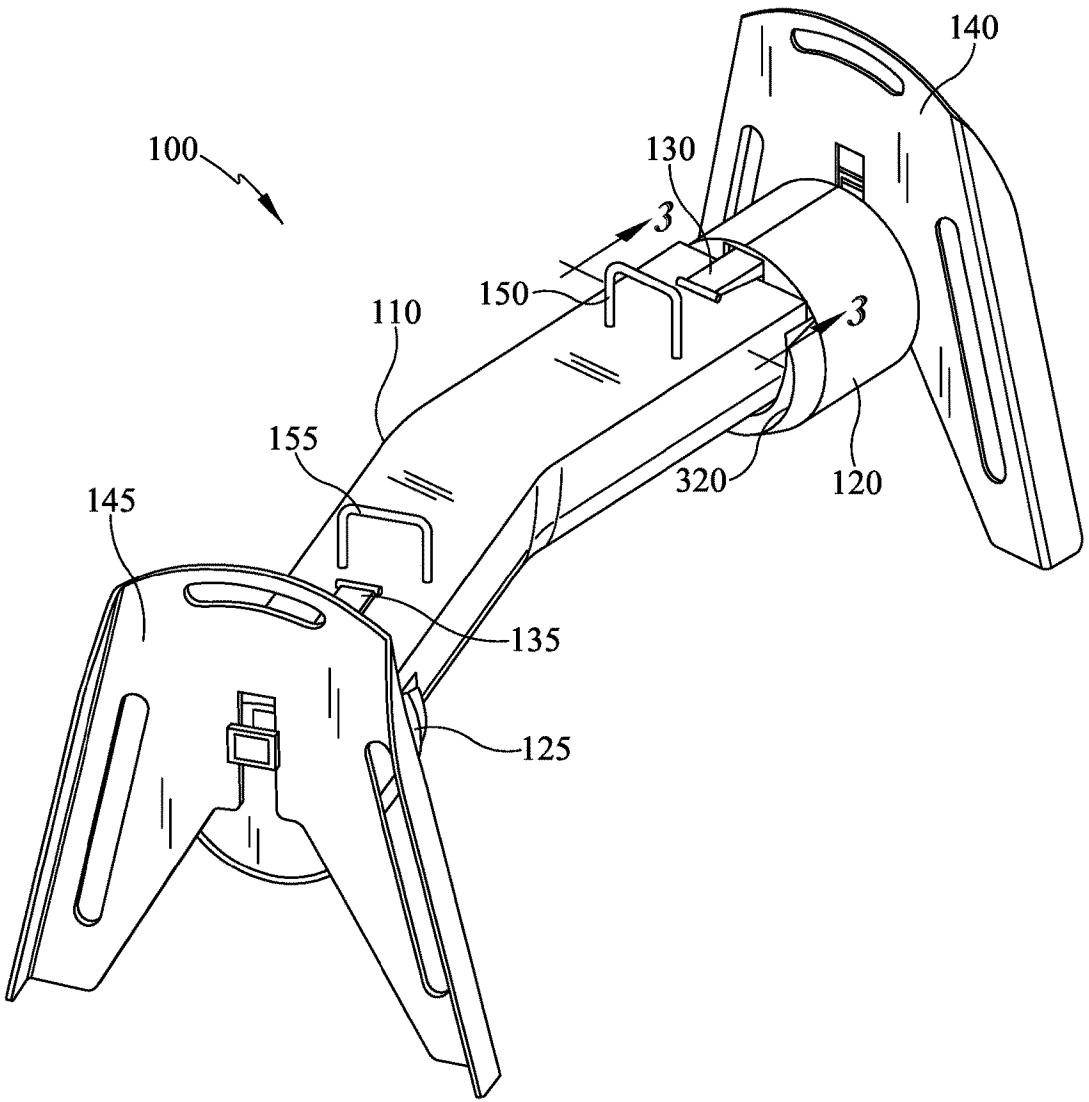
FIG. 1 is a perspective view of an embodiment of an apparatus for forming a flow channel for use in a prefabricated manhole described herein (manhole not illustrated in FIG. 1).

FIG. 1 shows a perspective view of an embodiment of an apparatus for forming a flow channel 100 for use in a prefabricated manhole described herein (manhole not illustrated in FIG. 1). The apparatus contains a channel form 110, which may be received by at least one bung 120, 125. The bungs 120, 125 may be inserted into the holes, one or more inlets or outlets, of the sidewalls of a prefabricated manhole. The channel form may be secured within the bung through the use of at least one movable wedge 130, 135. If used, at least one rotational lock 140, 145 may be used to reduce movement, rotation, and the like of the flow channel during the cement pouring and curing process. In some embodiments, the channel form may have one or more handles 150, 155 affixed to the form. Typically, although not limited to, the handles 150, 155 may be attached to the top of the form to facilitate moving and handling the channel form. These handles 150, 155, where present, may also facilitate the removal the channel form from the cement when the form is no longer required. Each portion of the apparatus will be discussed in further detail herein.

Figure 2:
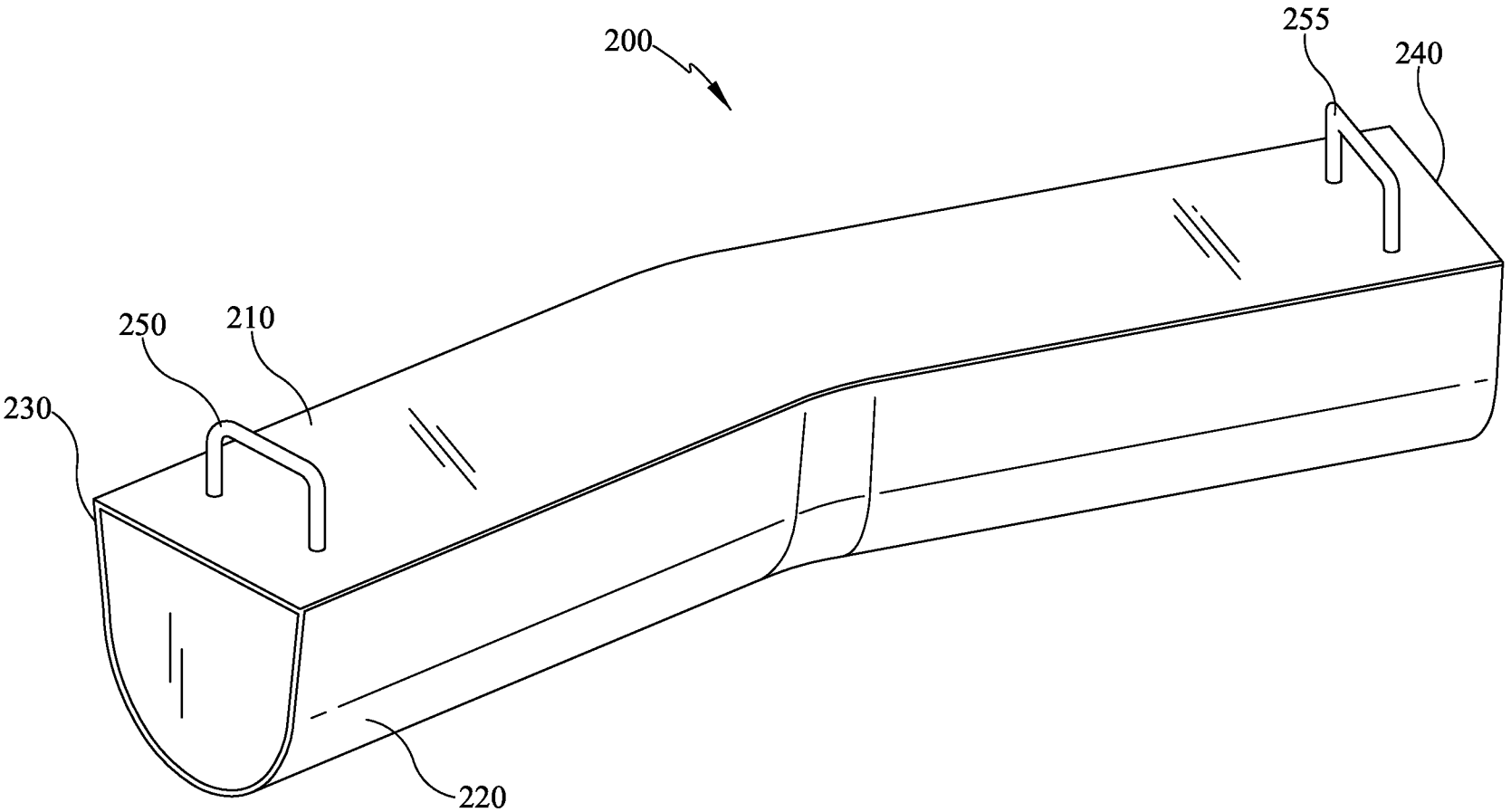
FIG. 2 is a perspective view of an embodiment of a flow channel form.

Referring now to FIG. 2, an embodiment of a channel form 200 is illustrated. The channel form 200 may be a hollow, rigid structure with a top 210, a curved bottom portion 220, a first end 230, and a second end 240. The channel form may be constructed from any materials known in the art to yield a rigid structure including, but not limited to, stainless steel, other metals, plastics, and the like. As used herein, the term "closed" may refer to embodiments that are either entirely enclosed or substantially enclosed. In some embodiments the channel form is entirely enclosed or closed, as illustrated in FIG. 2, which may prevent cement from entering the form. Cement entering the channel form may increase the weight of the form, and thus difficulty of removing the form after use. Furthermore, the cement entering channel forms may require the form to be cleaned, which may require additional time and resources. In other embodiments, the channel form is substantially enclosed, leaving only the ends, or portions of the ends, open. In some embodiments, handles 250, 255 may facilitate the movement and placement of the channel form.

The channel form may be a fixed size, including a fixed diameter of the curved bottom, a fixed length, and/or a fixed angle between ends of the form, which may correspond inlets and/or outlets in the sidewall of the prefabricated manhole. As such, each channel form may create a specific end product. For example, the curved bottom of the channel form may have a diameter of about 8 inches, about 10 inches, about 12 inches, or any other size required or known in the art. Furthermore, the curved bottom of the channel form may flare outwardly from the curved bottom towards the top of the form, so as to create a tapered structure. This tapered shape may facilitate easier removal of the channel form from the concrete. The angle between the inlets and/or outlets in the sidewall of the prefabricated manhole may vary based on the structural needs of the site where the manhole is to be placed; therefore, the angles of the channel form may correspondingly vary. In some embodiments, as illustrated in FIG. 2, the flow channel form 200 may have an angle of about 160 degrees. In other embodiments, the flow channel form may have an angle of about 90 degrees, about 100 degrees, about 110 degrees, about 120 degrees, about 130 degrees, about 140 degrees, about 150 degrees, about 160 degrees, about 170 degrees, about 180 degrees (or straight), about 190 degrees, about 200 degrees, about 210 degrees, about 220 degrees, about 230 degrees, about 240 degrees, about 250 degrees, about 260 degrees, about 270 degrees, or any value in-between. In other embodiments, the interaction of the flow channel form and the bung(s) may result in a final flow channel with about a ±5 degree difference angle from the angle of the flow channel form; for example, a flow channel form with an about 160 degree angle may result in an flow channel with an angle between about 155 degrees and about 165 degrees.

In some embodiments, the ends (each representing at least one inlet and/or outlet) of the flow channel form may be in substantially the same plane. In other embodiments, the ends (each representing at least one inlet and/or outlet) may be at differing heights on in the sidewall of the prefabricated manhole, thus creating a slope when the channel form is inserted (for example see FIG. 5). In still other embodiments, there may be more than two inlets or outlets in the sidewall of the prefabricated manhole. In such embodiments, a first channel form may be connected to a second channel form, mold, or the like. In some embodiments the first channel form may be removably connected to the second channel form, mold, or the like by a bracket, bolt, or strap for use with a three or four hole manhole. In other embodiments, the connection between the flow channel form and the second flow channel form may be permanent. In some embodiments at least one end of the second channel form may connect to at least one additional bung; in other embodiments, at least one end of the second channel form may be attached to the main flow. In still other embodiments at least one leg or branch (in addition to the flow channel created by the channel form) may be manually dug out while the concrete is curing.

Figure 3:
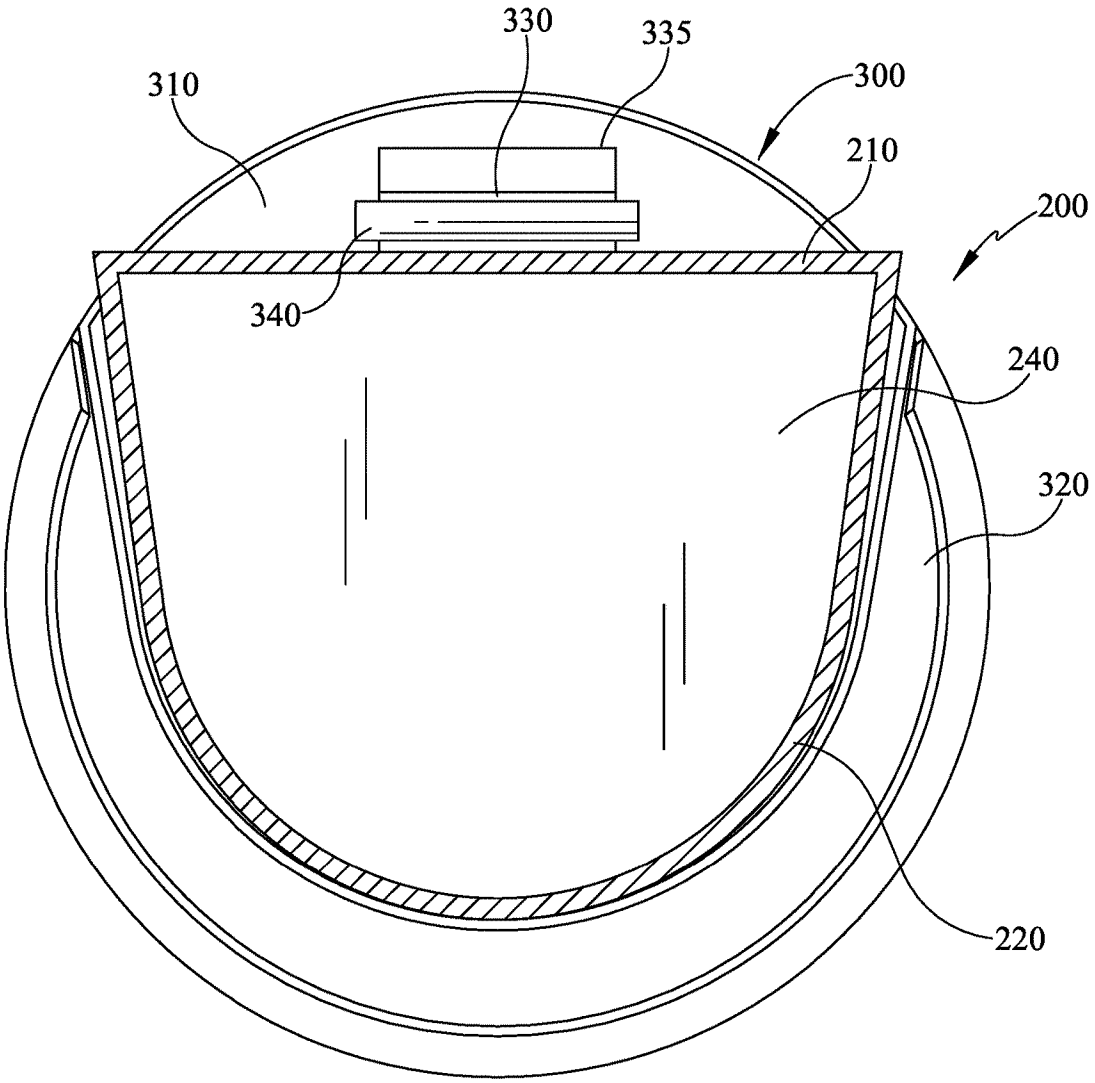
FIG. 3 is a cross-sectional view of the interior end of an embodiment of a bung receiving the flow channel form taken a long line 3-3 of FIG. 1 illustrating wedge in an engaged position in contact with channel.

Referring now to FIG. 3, cross-sectional view of the interior end of an embodiment of a bung 300 receiving the flow channel form 200 taken a long line 3-3 of FIG. 1 illustrating wedge in an engaged position in contact with channel. A bung itself may slide into an exterior hole (see 505, 510 of FIG. 5) of the manhole from the inside and/or outside of the manhole, which may be done prior to receiving the flow channel. The bung may have an exterior end (see 511 of FIG. 5), the end extending through to the exterior of the manhole or facing radially outwardly, and an interior end 310 which may receive an end of the channel form 230 and faces radially inwardly. The interior end 310 of the bung 300 may have an open ended U-shaped slot 320 for receiving an end of the flow channel form 230. The U-shape slot 320 extends radially inward from the interior end 310 of the bung 300 into the interior cavity of the prefabricated manhole structure. This U-shaped slot 320 cradles the curved bottom 220 on the channel form. Following the pouring and curing of concrete to generate the flow channel, the bung(s) may subsequently be removed from the recently poured concrete through radially outward movement. The void space left by the removal of the bung 300, specifically the U-shaped slot 320 of the bung 300, may provide an area for grout to be inserted about a pipe installed at a later time point in the manhole installation process. In some embodiments, the bung may be constructed from steel. However, this is not intended to be limiting, the wedge may be constructed from any durable material known in the art. The size of the bung may vary, and may be dependent on the size of the prefabricated manhole, channel form, and the like. For example, the size bung required for a flow channel pipe (and thus flow channel form) with a diameter of 8 inches may be smaller than that of a flow channel pipe (and thus flow channel form) with a diameter of 12 inches.

In some embodiments, the cured or partially cured concrete may be reshaped after the channel form is removed. This reshaping may include minor adjustments and/or major adjustments to the void left by the removal of the channel form. For example, post-form reshaping may be used to adjust the slope of the flow channel. Additionally, or alternatively, post-form reshaping may be used for construction of additional branches of flow channels off of flow channel formed by the void of the channel form, for example where a second channel form, mold, or the like was not used during the pouring of the concrete.

Between the exterior end (not illustrated in FIG. 3) and interior end 310 of the bung 300 may be a wedge 330 which passes through an opening 335 of the bung and which may slide back and forth (towards or away from the manhole). The wedge 335 may contain a first end (not illustrated in FIG. 3) which may project beyond the exterior end of the bung away from the prefabricated manhole, and a second end (340) which may project beyond the interior end 310 of the bung 300 into the interior of the manhole cavity relative to the bung 300. In some embodiments, the first and second ends of the wedges may contain flanges, as described herein. In some embodiments, the wedge may slide into contact with the channel form 200 into an engaged position, in such a position the flow channel 200 becomes fixed between the wedge and the U-shaped slot 320. The wedge may also slide out of contact with the channel form 200 in a disengaged position, in such a position the wedge is either inserted or removed from said U-shaped slot 320. In other embodiments, the engagement of wedge may cause the end of the channel form 200 to be pinned down with the U-shaped cradle portion, or slot 320 by the narrow tapered end of the wedge (not shown in FIG. 3). When the wedge is slid out, the channel form may become unpinned and disengaged, allowing the channel form to be removed, for example out of the recently poured concrete.

In some embodiments the wedge may be constructed from steel. However, this is not intended to be limiting, the wedge may be constructed from any durable material known in the art. In some embodiments, the wedge may further comprise flanges at one or both opposing ends to facilitate maintenance of the wedge's interconnectivity with the bung. Where present, the flanges may prevent the inadvertent separation of the bung and the wedge. This interconnectivity may be maintained due to the flange being larger in size than opening of the bung receiving the flange, such that the larger flange prevents the wedge from fully disconnecting with the bung. The size of the wedge may vary and may be dependent on the size of the bung, channel form, and/or prefabricated manhole.

In some embodiments, the wedge may further comprise a hole capable of receiving a pin, where the pin passes through the wedge into the flow channel. In some instances, pressure generated during the pouring and curing of the concrete may cause the bung(s) to move out of place in the hole of the sidewall. Therefore, in order to reduce axial movement of the apparatus, specifically the flow channel form and the bung, a pin may be inserted through the wedge and into the channel form may be desirable in some embodiments, for example where the flow channel is made of plastic.

Figure 4:
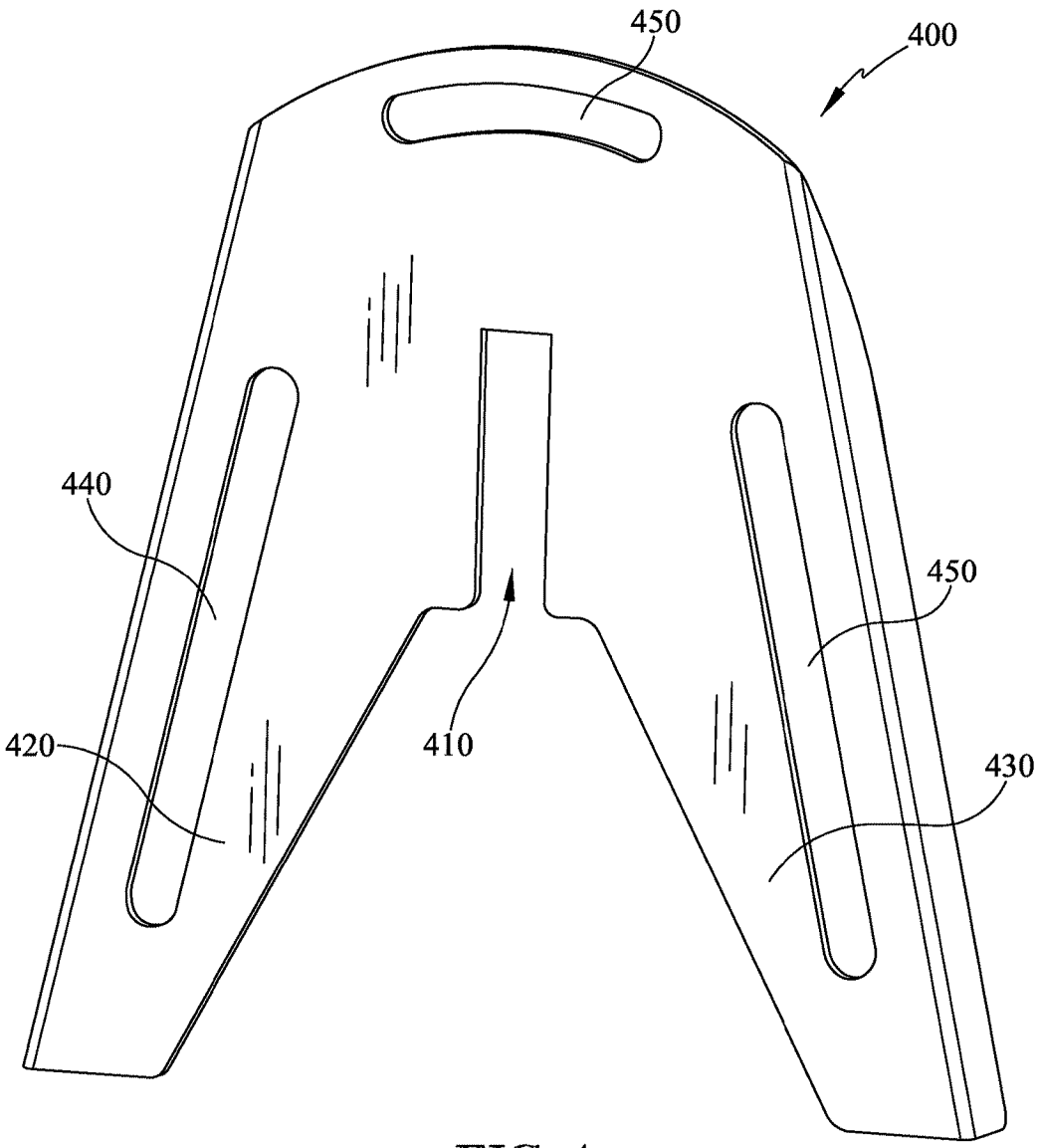
FIG. 4 is a front view of an embodiment of a perpendicularly oriented rotational lock.

In some aspects, the wedge may function to hold the flow channel form in position during the process of pouring and curing the concrete. However, as concrete is poured the channel form may become buoyant in the cement. This buoyancy may cause the flow channel form to move, affecting the quality of the mold or form remaining the cement. In some embodiments, to minimize and/or prevent such movement, a removable rotational lock may be included in the apparatus perpendicular to a slot and one or more legs. An embodiment of a rotational lock 400 is illustrated in FIG. 4. The rotational lock 400 has an open ended vertical slot 410 and two kickstand legs 420, 430 that extend downward from the vertical slot and may rest on the ground, or the surface where the prefabricated manhole is place. In some embodiments, the legs may be angled; in other embodiments the legs may be straight.

Figure 5:
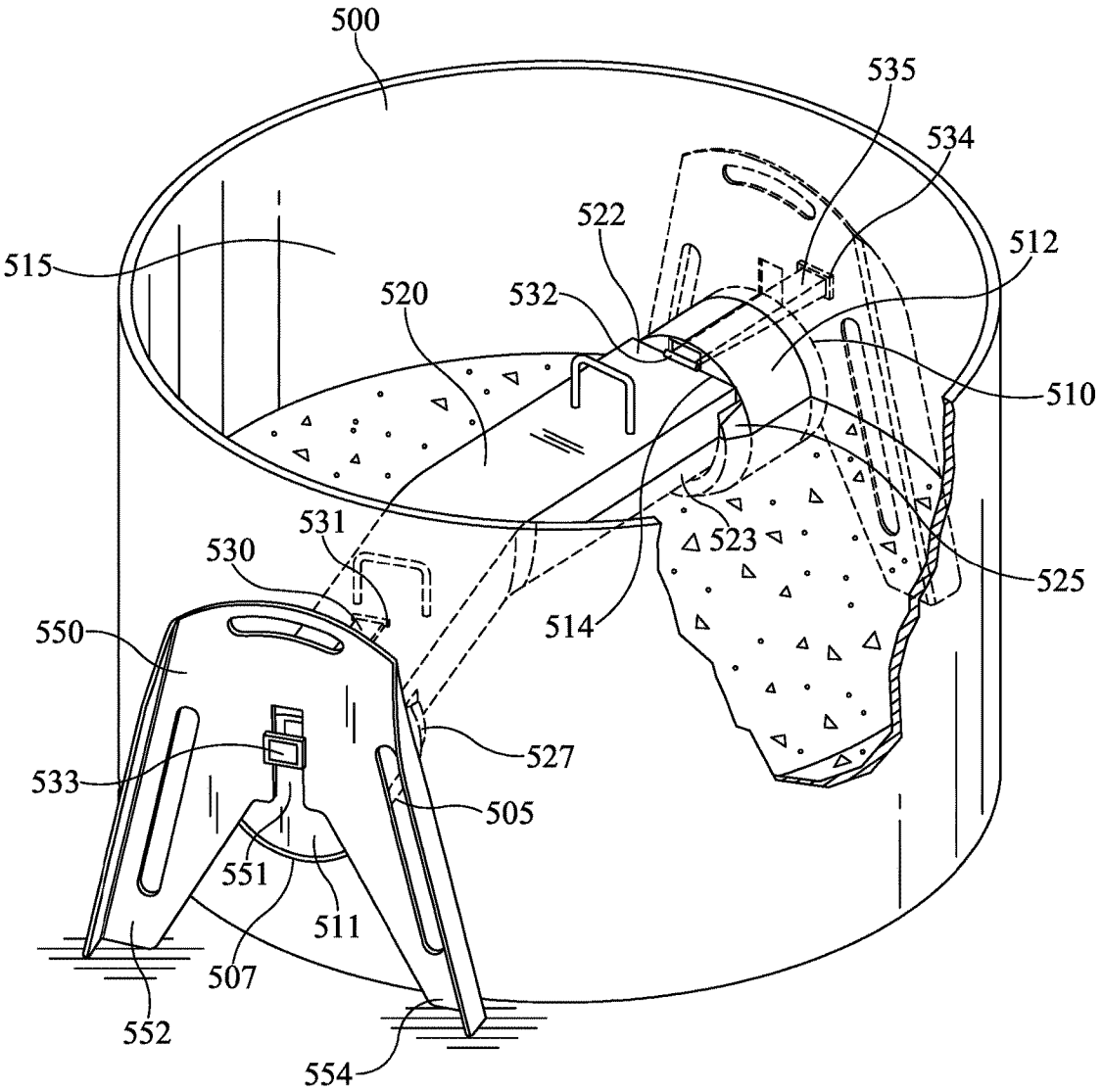
FIG. 5 is top perspective view of an embodiment of a flow channel form in conjunction with a prefabricated manhole.

The vertical slot 410 may be a point of attachment for the rotational lock and the wedge. In some embodiments (such as illustrated in FIG. 5), the lock may be wedged between the bung exterior 511, 516 and the flange and/or between the flange and sidewall 515. The vertical slot may be placed onto, in a straddling position, the first end of the wedge projecting beyond the exterior end of a bung. This attachment, via straddling, engages the flow channel form through the wedge. With the wedge straddled, the kickstand legs 420, 430 may extend downward and reach the ground, or any surface where the prefabricated manhole is placed. This attachment/engagement in combination with the kickstand legs 420, 430 resting on the ground (or any surface where the prefabricated manhole is placed) may limit, or in some cases restrict, the rotational movement of the flow channel form and/or bung created by the recently poured concrete. The flow channel may be naturally buoyant during and after concrete is poured, and the rotational lock counteracts this buoyancy and minimizes movement. While FIG. 4 is illustrated as having two kickstand legs, this is not to be understood to be limiting. A plurality of kickstand legs may be used, so long as the plurality of legs function to restrict the rotational movement of the flow channel form during and after the pouring and curing of the concrete. In some embodiments only one rotational lock may be used, while in other embodiments, each bung may have a rotational lock.

The vertical slot 410 of the rotational lock 400 may be long enough to accommodate varying wedge height positions that may exist due to variations in the exterior hole (inlet/outlet) height of the prefabricated manhole. Furthermore, the vertical slot may be substantially rectangular in shape, as illustrated in FIG. 4. Alternatively, or additionally, in some embodiments the vertical slot may be more triangular, or wedge-like, in shape in order to accommodate varying widths of wedges. The embodiment of a perpendicularly-oriented rotational lock illustrated in FIG. 4 contains additional openings 440, 450 on each of the two kickstand legs 420, 430 and an opening 445 above the slotted opening. In some embodiments these slotted openings 440, 445, 450 may be used as handles for easy transportation of the rotational lock. Furthermore, these openings 440, 445, 450 may reduce the overall weight of the rotational lock. However, these illustrated openings 440, 445, 450 are not to be understood as limiting, and other embodiments of a perpendicularly-oriented rotational lock may have a different arrangement of openings, fewer openings than illustrated, or no openings at all.

Referring now to FIG. 5, a top perspective view of an example embodiment of a flow channel form inserted into a prefabricated manhole with a portion of the manhole broken away in order to illustrate the at least partial curing of concrete to define the flow channel and/or voids left by the removal of the flow channel form. As illustrated in FIG. 5, the prefabricated manhole 500 contains two holes 505, 510, each of which may represent an inlet and/or outlet for fluid flow, in the sidewall 515 of the manhole. As illustrated in FIG. 5, the holes 505, 510 are at differing heights, thus creating a slope when the two holes 505, 510 are connected by the flow channel form 520. However, this is not intended to be limiting, in some embodiments the holes may be positioned at substantially the same height, resulting in a flow channel that is substantially planar, without significant slope. As illustrated, the holes 505, 510 each have a bung 507, 512 inserted therein. Each bung 507, 512 contains and interior end 514 (although only one interior end is visible in FIG. 5) that faces the interior cavity of the prefabricated manhole, and an exterior end 511 (although only one exterior end is visible in FIG. 5) that faces outwardly from the prefabricated manhole. The flow channel 520 is inserted into the interior end 514 of each bung 507, 512. The interior ends 514 of each bung 507, 512 may also have an open ended U-shaped slot 525, 527 for receiving an end 521, 522 of the flow channel form 520. Each U-shape slot 525, 527 extends radially inward from the interior end 514 of the bung 507, 512 into the interior cavity of the prefabricated manhole structure. These U-shaped slots 525, 527 cradle the curved bottom 523 on the channel form 520. Although illustrated in FIG. 5 as containing two holes, as inlets and/or outlets for fluid flow, this is not intended to be limiting, as the prefabricated manhole may have two, three, four, or any other number of holes as is recognized by one of skill in the art for preforming the manhole's desired function.

As illustrated in FIG. 5, each hole 505, 510, bung 507, 512, flow channel end 522 combination may further contain a wedge 530, 535 that passes through the bung 507, 512 such that a first end of the wedge 531, 532 is positioned within the interior cavity of the manhole and a second end of the wedge 533, 534 has passed through the bung 507, 512 and the sidewall 515 and is located on the exterior of the manhole 500. The wedge 530 may slide towards the interior cavity of the manhole and into contact with the channel form 520 into an engaged position (as illustrated by wedge 530). In such an engaged position, the flow channel 520 becomes fixed between the wedge 530 and the U-shaped slot 527. The wedge 535 may also slide towards the exterior of the manhole and out of contact with the channel form 520 into a disengaged position (as illustrated by wedge 535). Such a disengaged position may allow the channel form to be either inserted or removed from said U-shaped slot 525 and from the manhole 500. In some embodiments, a wedge in an engaged position may pin a flow channel for down into contact with a U-shaped slot. In such an embodiment, a flow channel may become unpinned when a wedge is slid out. In some embodiments, the wedge may further contain flanges to maintain interconnectivity with the bung.

As discussed herein, particularly with respect to FIG. 4, it may be desirable in some embodiments to provide a rotational lock in order to reduce and/or prevent movement of the channel form during the process of pouring and curing the concrete, as the channel form may become buoyant in the cement. In some embodiments, in order to minimize and/or prevent such movement, a removable rotational lock 550 may be included in the apparatus. Such a rotation lock may be oriented perpendicularly with respect to the second end of the wedge 533. As previously described with respect to FIG. 4, such a rotational lock may comprise an open ended vertical slot 551 and at least two kickstand legs 552, 554 that extend downward from the vertical slot and may rest on the ground, or the surface where the prefabricated manhole is place. As illustrated in FIG. 5, the vertical slot 551 may be an attachment point for the rotational lock 550 and the wedge 530, more particularly the second end of the wedge 533. In some embodiments, as illustrated, the lock 550 may be positioned between the exterior end 511 of the bung 507 and the sidewall 515. The vertical slot 551 may be placed onto, in a straddling position, the second end of the wedge 533, the end projecting beyond the exterior end 511 of a bung. While illustrated as having two kickstand legs, this is not to be understood to be limiting, a plurality of kickstand legs may be used to restrict the rotational movement of the flow channel form during and after the pouring and curing of the concrete. In some embodiments only one rotational lock may be used, as illustrated in FIG. 5, while in other embodiments, each bung may have a rotational lock.

It should be noted that although the preceding description may refer to only a single bung, wedge, rotational lock, etc. this is not intended to be limiting. Embodiments of the inventive apparatus may include a plurality of holes in the sidewall of a manhole for receiving bungs, and correspondingly a plurality of bungs. Accordingly, a plurality of wedges and rotational locks may be used as well.

Figure 6:
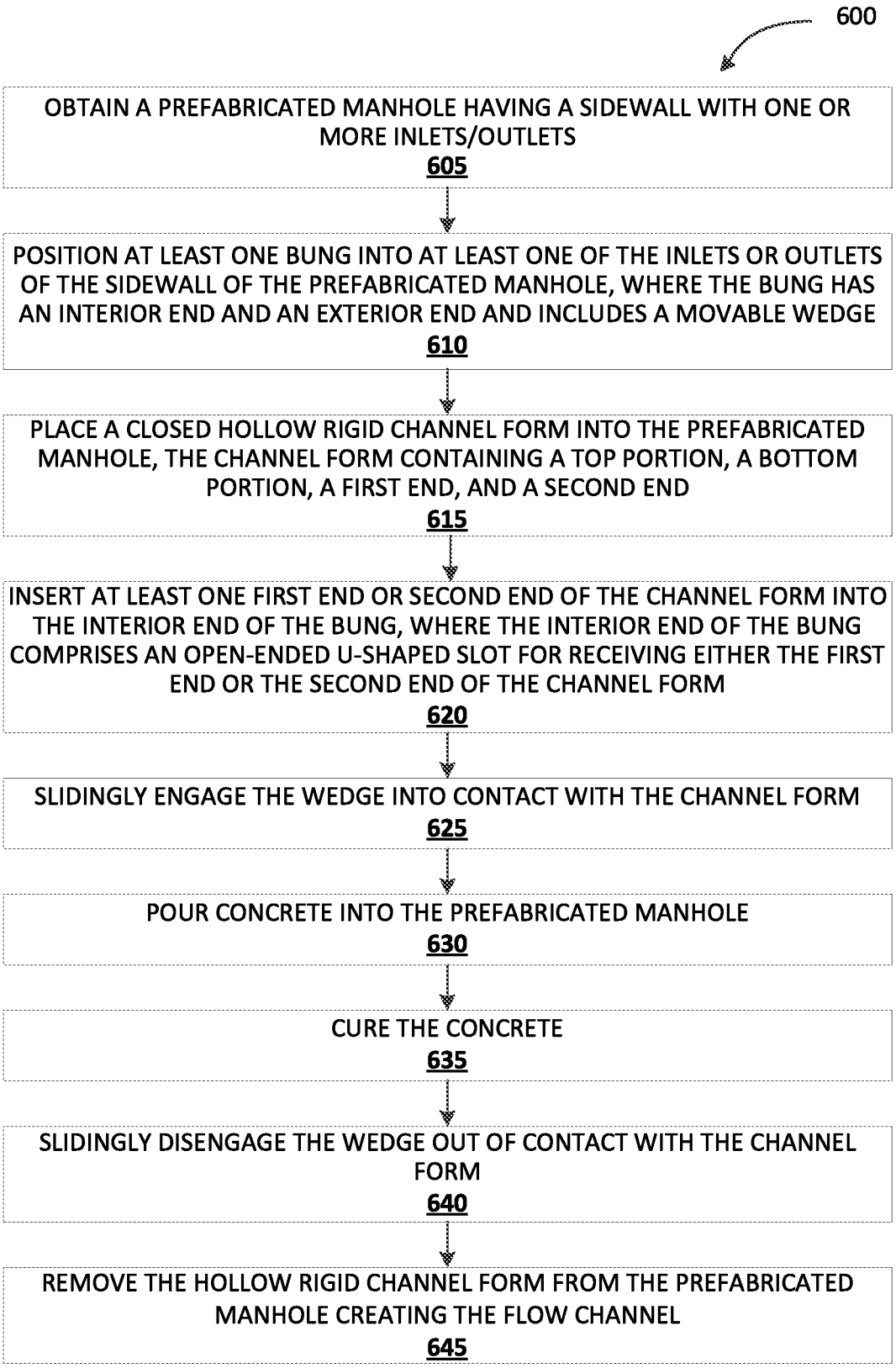
FIG. 6 is a flow diagram of an exemplary method of manufacturing a flow channel in a prefabricated manhole.

Referring now to FIG. 6, which illustrates an exemplary method 600 for manufacturing a flow channel in a prefabricated manhole. At step 605 a prefabricated manhole is obtained. Any type or size of manhole known in the art may be obtained, as the specific characteristics of the manhole may depend on the desired positioning and use of the manhole with flow channel. At step 610, a bung, such as described herein, may be positioned into a hole of a sidewall of the prefabricated manhole. The bung may be positioned so as to have an exterior end and an interior end, interior end facing the interior of the manhole. Typically, the prefabricated manhole has at least two holes (inlets/outlets) in its sidewalls capable of receiving bungs, but this is not intended to be limiting and the sidewalls of the manhole may have as many or few as is practical for the use of the manhole for its intended purpose. Furthermore, it is preferable that at least two bungs be positioned into the holes of the sidewall of the manhole, such that each end of a channel form may be received.

At step 615, a closed hollow rigid channel form is placed into the manhole. As described herein the channel form has a top portion, bottom portion, and a first end and a second end. In some embodiments, the entire channel form is closed. In other embodiments, the channel form is substantially closed, only remaining open, or partially open, at the two ends. At step 620, at least one end, and preferably both ends, of the channel form are inserted into interior ends of the bungs. The interior end of the bung, the end inside of the manhole, has an open-ended U-shaped slot that receives the end of the channel form. This U-shaped slot produces a U-shaped void when the flow channel form is removed following the pouring of concrete. This U-shaped void may be used for applying grout to a pipe that is installed in the manhole following the completion of the construction of the flow channel.

At step 625, a movable wedge that passes through the bung, may be positioned between an exterior end and an interior end of a bung. This wedge may be engaged by sliding the wedge into contact with the channel form and towards the prefabricated manhole relative to the channel form. In some embodiments, this engagement may pin down the channel form to the U-shaped slot of the bung. In some embodiments, as described herein, the wedge has a flange at each end, allowing the wedge to maintain interconnectivity with the bung. The flanges on the opposing ends of the wedge, along with the rotational lock, if used, may minimize longitudinal movement. In other embodiments, the wedge may have a hole for receiving a pin, where the pin passes through the wedge into the channel form in order to reduce axial movement of the apparatus, specifically the channel form and bung(s).

Optionally, at least one rotational lock may attach to the end of the wedge that extends outward from the exterior end of the bung (e.g. the end of the wedge that is not inside of the manhole. The vertical slot of the rotational lock may function as a point of attachment with the end of the wedge and one or more kickstand legs extending downward. The one or more kickstand legs rest on a surface below the prefabricated manhole, such as the ground. By resting on the surface below the manhole (e.g. the ground) the kickstand legs minimize the effect of rotation on the flow channel form. Where used, the rotational lock may be detached from the end of the wedge by pulling up vertically on the rotational lock. The rotational lock may then be set aside for later use in forming another flow channel in a separate manhole.

At step 630, the concrete is poured into the manhole. At step 635, the concrete is at least partially cured. While the term "curing" is used herein, it is to be understood that curing may include both partially-cured concrete as well as fully cured concrete, and anywhere between. At step 640, the movable wedge is disengaged by sliding the edge away from the manhole relative to the channel form, which unpins the channel form.

At step 645, the hollow, rigid channel form is removed from the manhole. This removal creates a void in th3*e* concrete, for example to be used as a flow channel, in the place where the form was during the portion and curing of the concrete. In some embodiments, a pipe may be placed into the flow channel created by the method 600, illustrated in FIG. 6. In these embodiments, the size of the pipe would correspond to the size of the flow channel created. For example, where the curved bottom of the flow channel form had a diameter of about 8 inches, the pipe placed into the flow channel created by that form may also have a diameter of about 8 inches.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended to the application once filed as a non-provisional application.

What is claimed is:

1. A reusable apparatus for forming a flow channel for use in a prefabricated manhole, said apparatus comprising:

a rigid channel form, said channel form comprising a closed top portion, a curved bottom portion, a first end, and a second end;

at least one bung removably positioned into an exterior hole through a sidewall of said prefabricated manhole, wherein said at least one bung is configured to receive one of said first or said second end of said channel form, wherein said at least one bung comprises an interior end removably connected to said channel form and an exterior end, said interior end of the at least one bung further comprising an open-ended U-shaped slot receiving said one of said first end or said second end of said channel form; and at least one movable wedge slidably received by said at least one bung, said wedge slides between an engaged position wherein said flow channel is fixed between said wedge and said U-shaped slot and a disengaged position wherein said flow channel is either inserted or removed from said U-shaped slot.

2. The apparatus of claim 1, wherein said apparatus further comprises at least one rotational lock removably engaged with a first end of said wedge extending outward from said exterior end of said bung.

3. The apparatus of claim 2, wherein said at least one rotational lock includes a main body with a slot between a plurality of depending legs, wherein said slot releasably receives said first end of said wedge.

4. The apparatus of claim 2, wherein said at least one rotational lock further comprises a vertical slot that is a point of attachment with said wedge and a plurality of kickstand legs extending downward such that each of said plurality of kickstand legs rest on a surface below said prefabricated manhole.

5. The apparatus of claim 4, wherein said plurality of kickstand legs resist rotational forces created by recently poured concrete.

6. The apparatus of claim 1, wherein each said first and said second ends of said rigid channel form are tapered, such that a width of said closed top portion of each said first and said second end is larger than said curved bottom portion of each said first and said second end.

7. The apparatus of claim 1, wherein said hollow rigid channel form is substantially closed at each of said first and said second ends.

8. The apparatus of claim 1, wherein when in said disengaged position said wedge is slid outwardly away from said exterior end of said bung, allowing said channel form to be removed from said prefabricated manhole.

9. The apparatus of claim 1, wherein a void is left by said U-shaped slot, said void providing a space for grout to be inserted about a pipe during an installation process.

10. The apparatus of claim 1, wherein said at least one wedge has a flange at each opposing end to maintain interconnectivity with said bung.

11. The apparatus of claim 10, wherein said flange at each opposing end holds said at least one rotational lock from sliding along a longitudinal axis.

12. The apparatus of claim 1, wherein said apparatus further comprises another rigid channel form, wherein said rigid channel form is a different angle than said another rigid channel form.

* * * * *